US005497639A

United States Patent [19]

Charlot, Jr.

[11] Patent Number: 5,497,639

[45] Date of Patent: Mar. 12, 1996

[54] NON-CUTTABLE DEVICE FOR ATTACHMENT OF SHOPLIFTING DETECTION TAG

[75] Inventor: Lincoln H. Charlot, Jr., St. Petersburg, Fla.

[73] Assignee: Link Enterprises, Inc., St. Petersburg, Fla.

[21] Appl. No.: 340,265

[22] Filed: Nov. 15, 1994

[51] Int. Cl.[6] ..... E05B 65/00

[52] U.S. Cl. ..... 70/57.1; 24/527; 24/704.1; 403/340

[58] Field of Search ..... 70/57.1, 36, 37; 24/522, 529, 459, 527, 704.1, 706.8; 403/207, 209, 340; 248/316.4, 231.4

[56] References Cited

U.S. PATENT DOCUMENTS

| | | | |
|---|---|---|---|
| 155,344 | 9/1874 | Szabo | 403/209 X |
| 2,073,601 | 3/1937 | Beach | 24/706.8 X |
| 2,399,339 | 4/1946 | Foster | 24/522 X |
| 2,759,166 | 8/1956 | Mallina | 403/209 X |
| 2,826,855 | 3/1958 | Troccia | 24/706.8 X |

*Primary Examiner*—Lloyd A. Gall
*Attorney, Agent, or Firm*—Edward W. Callan

[57] ABSTRACT

A device for enabling attachment of a shoplifting detection tag to an article to be protected includes a first attachment rod having an eyelet at one end, a center portion having a bend, and a straight portion at the opposite end from the eyelet suitable for insertion into a clutch mechanism of a shoplifting detection tag; and a second attachment rod having an eyelet at one end, a center portion having a bend, and a straight portion at the opposite end from the eyelet. The first and second attachment rods and the eyelets thereof are of such relative dimensions that the first and second attachment rods may be fitted together to encompass a portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag. The attachment rods are made from steel rods that are hardened so as not to be cuttable with hand tools.

14 Claims, 1 Drawing Sheet

NON-CUTTABLE DEVICE FOR ATTACHMENT OF SHOPLIFTING DETECTION TAG

BACKGROUND OF THE INVENTION

The present invention generally pertains to shoplifting detection devices and is particularly directed to an improvement in the means for attaching shoplifting detection tags to articles of merchandise.

Shoplifting detection tags are described in U.S. Pat. No. 4,987,754 to Minasy et al. and U.S. Pat. No. 4,481,428 to Charlot. One such use is in the protection of women's hand bags; wherein the shoplifting detection tag is attached to the hand bag to be protected by piercing the strap or some other portion of the hand bag with a large-headed pin and then inserting the pin shaft into a clutch mechanism within the tag. Clutch mechanisms are described in U.S. Pat. No. 4,523,356 to Charlot and U.S. Pat. No. 4,221,025 to Martens et al.

Alternatively, articles such as hand bags may be protected by encirclement of the strap with a flexible-wire device, commonly referred to as a "lanyard", that includes a several-inch long piece of wire that has small loops at each end. The wire is passed around the strap, each loop end is secured under the head of the pin and the pin is inserted into the clutch mechanism of a shoplifting detection tag.

Of lesser popularity is the use of a clamping-action plate built into the shoplifting detection tag. By providing a plate hinged at one end of the tag and having a pin mounted at the free end of the plate for insertion into a clutch mechanism at the other end of the tag, a portion of the article to be protected may be clamped between the plate and the tag body when the pin is inserted into the clutch mechanism. Although this clamp-action method of tag attachment has been in use for over three decades, its popularity is diminishing due to its susceptibility to defeat and its unnecessary bulk, size and weight. The defeatable aspect is the susceptibility of the hinged plate to being pried away from the tag body to thereby break the plate, the tag body or the clutch mechanism.

The other methods described above, although more commonly used, also suffer from serious deficiencies. The puncture method is objectionable because it leaves a visible pin hole in some articles, particularly leather goods, and it cannot be used with any non-puncturable merchandise. The flexible-wire lanyard method is subject to easy defeat by cutting the wire. Increasing the diameter of the wire or hardening of the wire to resist cutting creates a level of inflexibility which inhibits the use of the lanyard on smaller articles.

SUMMARY OF THE INVENTION

The present invention provides a device for enabling attachment of a shoplifting detection tag to an article to be protected, comprising a first attachment rod having an eyelet at one end, a center portion having a bend, and a straight portion at the opposite end from the eyelet suitable for insertion into a clutch mechanism of a shoplifting detection tag; and a second attachment rod having an eyelet at one end, a center portion having a bend, and a straight portion at the opposite end from the eyelet; wherein the first and second attachment rods and the eyelets thereof are of such relative dimensions that the first and second attachment rods may be fitted together to encompass a portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag.

The device of the present invention is inherently adjustable so that it may be used to attach a shoplifting detection tag to any of a wide variety of articles of different sizes by varying the amount by which the first attachment rod is inserted into the clutch mechanism of the tag.

Also the attachment rods of the device of the present invention may be dimensioned specifically for attachment to given articles of merchandise in accordance with the shapes and/or dimensions of such articles.

The configuration of the attachment rods is such that they can be manufactured so as not be cuttable with hand tools, thereby preventing the use of such tools to detach the device of the present invention from a shoplifting detection tag.

The present invention further provides a process of manufacturing attachment rods for use with a shoplifting detection tag, comprising the steps of:

(a) providing a metal rod having an eyelet at one end;

(b) machining the provided rod to have such dimensions that a straight portion at the opposite end of the rod from the eyelet can be passed through the eyelet of a second provided said rod;

(c) bending a central portion of the machined rod; and (d) hardening the bent rod to render the rod non-machinable.

The present invention also provides a method of attaching a shoplifting detection tag to an article to be protected, comprising the steps of:

(a) providing an attachment device including a first attachment rod having an eyelet at one end, a center portion having a bend, and a straight portion at the opposite end from the eyelet suitable for insertion into a clutch mechanism of a shoplifting detection tag; and a second attachment rod having an eyelet at one end, a center portion having a bend, and a straight portion at the opposite end from the eyelet; wherein the first and second attachment rods and the eyelets thereof are of such relative dimensions that the first and second attachment rods may be fitted together to encompass a portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag;

(b) fitting the first and second attachment rods together to encompass said portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag; and (c) inserting the straight portion of the first rod into the clutch mechanism of the shoplifting detection tag.

Additional features of the present invention are described with reference to the detailed description of the preferred embodiments.

DETAILED DESCRIPTION

Figure 1:
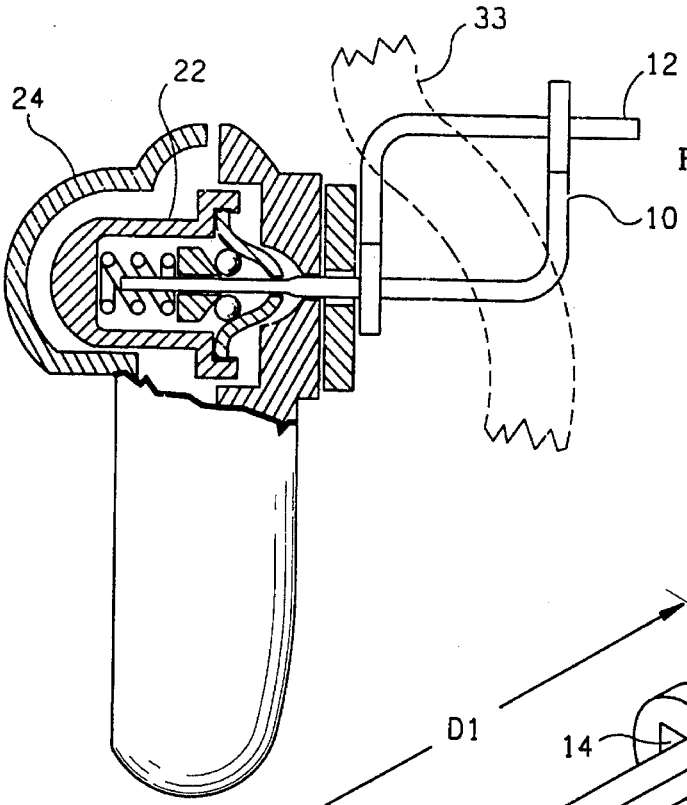
FIG. 1 illustrates the attachment of the device of the present invention to a shoplifting detection tag with a portion of the tag broken away to show the insertion of an attachment rod into the clutch mechanism of the tag and with a portion of an article of merchandise encompassed by such device being shown in phantom lines.
Figure 2:
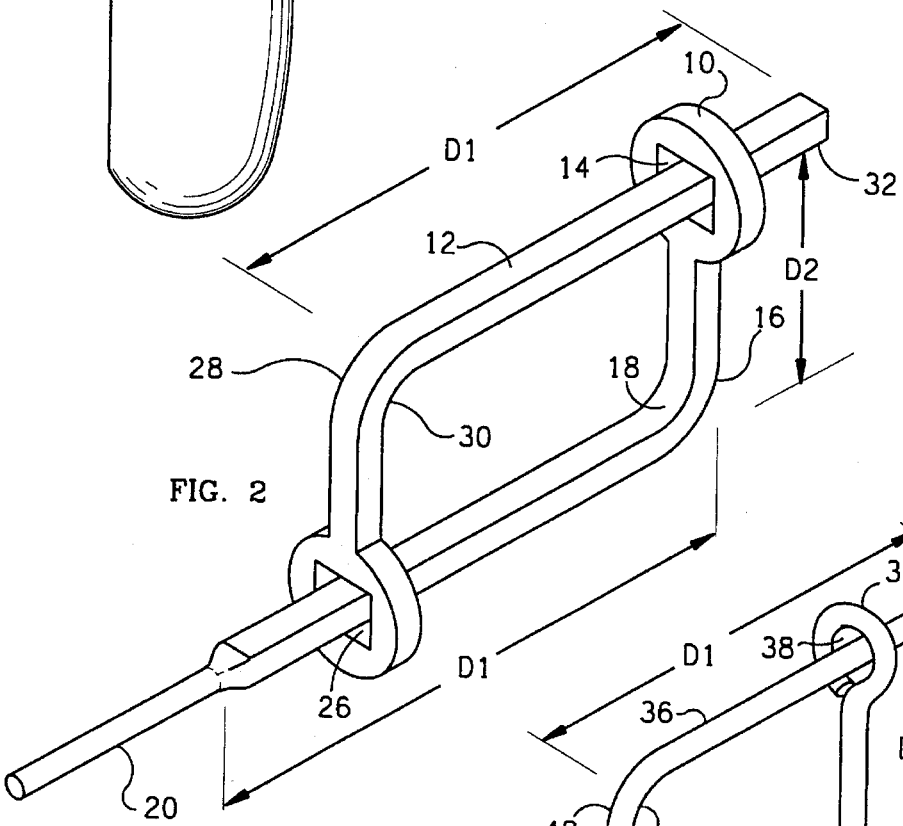
FIG. 2 is a perspective view of a preferred embodiment of the device of the present invention manufactured from rectangular steel bars, with one end of one rod having a rounded shape suitable for insertion into a clutch mechanism of a shoplifting detection tag.

Referring to FIGS. 1 and 2, one preferred embodiment of the device of the present invention includes two similarly shaped rigid steel attachment rods 10, 12. One attachment rod 10 has an eyelet 14 at one end, a center portion 16 having a bend 18, and a straight portion 20 at the opposite end from the eyelet 14, with the straight portion 20 having a rounded shape and being of such dimensions that it 20 is suitable for insertion into a clutch mechanism 22 of a shoplifting detection tag 24. The other attachment rod 12 has an eyelet 26 at one end, a center portion 28 having a bend 30, and a straight portion 32 at the opposite end from the eyelet 26.

The first attachment rod 10 and second attachment rod 12 and the eyelets 14, 26 thereof are of such relative dimensions that the first and second attachment rods 10, 12 may be fitted together to encompass a portion 33 of an article to be protected, such as the strap of a purse, by passing the straight portion 20 of the first rod 10 through the eyelet 26 of the second rod 12 and by passing the straight portion 32 of the second rod 12 through the eyelet 14 of the first rod 10, while allowing the straight portion 20 of the first rod 10 to be inserted into the clutch mechanism 22 of the shoplifting detection tag 24.

The attachment rods 10, 12 have a non-machinable hardness of at least Rockwell "C" 45, whereby the attachment rods 10, 12 cannot be cut by hand tools. Also the portions of the attachment rods 10, 12 respectively defining the eyelets 14, 26 are seamless in that there is no parting line between any portion of each rod 10, 12 defining the eyelet 14, 26 and some other part of the rod, such as would occur, for example, if the portion of the rod defining the eyelet were welded onto the remainder of the rod.

The attachment rods 10, 12 are manufactured by a process including the steps of:

(a) providing a rigid steel rod having an eyelet 14, 26 at one end;

(b) machining the provided rod 10, 12 to have such dimensions that a straight portion 20, 32 at the opposite end of the rod from the eyelet 14, 26 can be passed through the eyelet 26, 14 of a second provided rod 12, 10;

(c) bending a central portion 16, 28 of the machined rod 10, 12; and (d) hardening the bent rod 10, 12 to a hardness of at least Rockwell "C" 45 to thereby render the rod non-machinable.

While machining the first attachment rod 10, the straight portion 20 at the opposite end of the first rod 10 from the eyelet 14 thereof is machined to be suitable for insertion into a clutch mechanism of a shoplifting detection tag. Preferably, such machining of the straight portion 20 of the first attachment rod 10 is performed prior to the step (c) of bending the central portion 16 of the first rod 10; although it could be so machined after step (c) but prior to the step (d) of hardening the bent first rod 10. It is not necessary to so machine the straight portion 32 at the opposite end of the second attachment rod 12 from the eyelet 26 thereof to be suitable for insertion into a clutch mechanism of a shoplifting detection tag; and preferably one would avoid the cost of doing so.

The first and second attachment rods 10, 12 may be provided from metal rods having either a rectangular cross-section, as shown in FIG. 2, or having a round cross-section (not shown). The eyelets 14, 26 are provided by drilling at one end of the respective first and second attachment rods 10, 12. When metal rods having a round cross-section are provided, one end of each rod is pounded relatively flat and the eyelet is provided by drilling at the flattened end of the rod.

In a preferred embodiment that is dimensioned for encompassing a 0.25 inch diameter portion of an article to be protected, the cross-sectional dimension of the predominant portions of the attachment rods 10, 12 is approximately 0.125 inch by 0.0625 inch; the eyelets 14, 26 have an inside dimension of approximately 0.130 inch by 0.067 inch; the outside dimension of the end portion of the rods 10, 12 containing the eyelets 14, 26 is approximately 0.375 inch; the dimension D1 is 1.25 inch; and the dimension D2 is 0.5 inch. In this embodiment, the straight portion 20 of the first rod 10 that is machined to be suitable for insertion into a clutch mechanism of a shoplifting detection tag has a length of approximately 0.5 inch and a diameter of approximately 0.05 inch.

Figure 3:
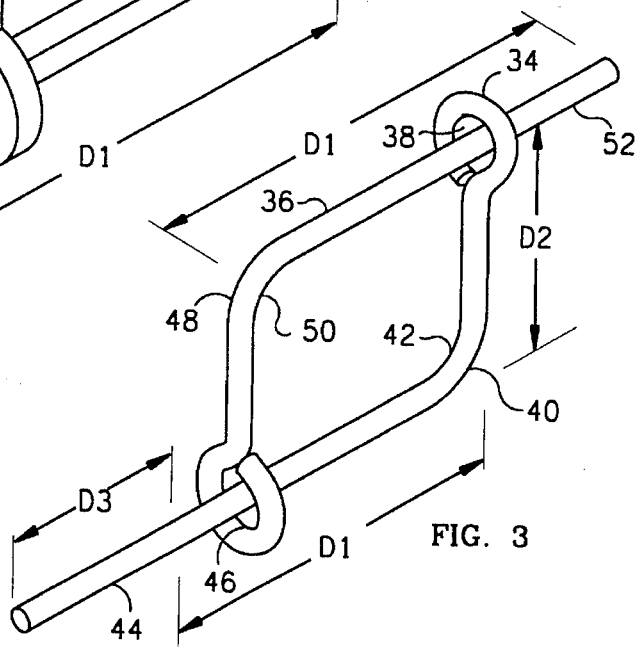
FIG. 3 is a perspective view of an alternative preferred embodiment of the device of the present invention manufactured from semi-flexible steel rods, with one end of each rod having a rounded shape suitable for insertion into a clutch mechanism of a shoplifting detection tag.

Referring to FIGS. 1 and 3, another preferred embodiment of the device of the present invention includes two similarly shaped steel attachment rods 34, 36. One attachment rod 34 has an eyelet 38 at one end, a center portion 40 having a bend 42, and a straight portion 44 at the opposite end from the eyelet 38, with the straight portion 44 having a rounded shape and being of such dimensions that it 44 is suitable for insertion into a clutch mechanism 22 of a shoplifting detection tag 24. The other attachment rod 36 has an eyelet 46 at one end, a center portion 48 having a bend 50, and a straight portion 52 at the opposite end from the eyelet 46.

The first attachment rod 34 and second attachment rod 36 and the eyelets 38, 46 thereof are of such relative dimensions that the first and second attachment rods 34, 36 may be fitted together to encompass a portion 33 of an article to be protected, such as the strap of a purse, by passing the straight portion 44 of the first rod 34 through the eyelet 46 of the second rod 36 and by passing the straight portion 52 of the second rod 36 through the eyelet 38 of the first rod 34, while allowing the straight portion 44 of the first rod 34 to be inserted into the clutch mechanism 22 of the shoplifting detection tag 24.

The attachment rods 34, 36 are made from a thin semi-flexible wire rope that cannot be cut by hand tools, such as used for high tensile strength 300 pound fishing line. Such semi-flexibility facilitates the insertion of the straight ends 44, 52 of the first and second attachment rods 34, 36 into the eyelets 46, 38 of the second and first attachment rods 36, 34.

In a preferred embodiment that is dimensioned for encompassing a 0.25 inch diameter portion of an article to be protected, the cross-sectional diameter of the attachment rods 34, 36 is approximately 0.05 inch; the eyelets 38, 46 have an inside diameter of approximately 0.1 inch; the dimension D1 is 1.25 inch; the dimension D2 is 0.5 inch; and the dimension D3 is approximately 0.5 inch.

The device of the present invention is useful for attaching shoplifting detection tags to many different types of merchandise in addition to women's hand bags, such as jewelry, tennis racquets, and other non-clothing articles that usually require pins or wire lanyards for attachment. Using the device of the present invention, the tag may be attached directly to the article by fitting the attachment rods together to encompass a portion of the article such as the strap of a hand bag, the strings of a tennis racquet, or the band of a jewelry item such as a ring or bracelet.

While the above description contains many specificities, these should not be construed as limitations on the scope of the present invention, but rather as exemplifications of the preferred embodiments described herein. Other variations are possible and the scope of the present invention should be determined not by the embodiments described herein but rather by the claims and their legal equivalents.

What is claimed is:

1. A method of attaching a shoplifting detection tag to an article to be protected, comprising the steps of:

(a) providing an attachment device including a first attachment rod having an eyelet at one end, a center portion having a bend, and a straight portion at the opposite end from the eyelet suitable for insertion into a clutch mechanism of a shoplifting detection tag; and a second attachment rod having an eyelet at one end, a center portion having a bend, and a straight portion at the opposite end from the eyelet; wherein the first and second attachment rods and the eyelets thereof are of such relative dimensions that the first and second attachment rods may be fitted together to encompass a portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag;

(b) fitting the first and second attachment rods together to encompass said portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag; and (c) inserting the straight portion of the first rod into the clutch mechanism of the shoplifting detection tag.

2. A method according to claim 1, wherein the rods have a non-machinable hardness.

3. A method according to claim 1, wherein the rods have a hardness of at least Rockwell "C" 45.

4. A method according to claim 1, wherein the rods are of such hardness that the rods cannot be cut by hand tools.

5. A method according to claim 1, wherein the portions of the rods defining the eyelets are seamless.

6. A device for enabling attachment of a shoplifting detection tag to an article to be protected, comprising a first attachment rod having an eyelet at one end, a center portion having a bend, and a straight portion at the opposite end from the eyelet comprising a means for insertion into a clutch mechanism of a shoplifting detection tag; and a second attachment rod having an eyelet at one end, a center portion having a bend, and a straight portion at the opposite end from the eyelet;

wherein the first and second attachment rods and the eyelets thereof are of such relative dimensions that the first and second attachment rods may be fitted together to encompass a portion of the article to be protected by passing the straight portion of the first rod through the eyelet of the second rod and by passing the straight portion of the second rod through the eyelet of the first rod, while allowing the straight portion of the first rod to be inserted into the clutch mechanism of the shoplifting detection tag.

7. A device according to claim 6, wherein the rods have a non-machinable hardness.

8. A device according to claim 6, wherein the rods have a hardness of at least Rockwell "C" 45.

9. A device according to claim 6, wherein the rods are of such hardness that the rods cannot be cut by hand tools.

10. A device according to claim 6, wherein the portions of the rods defining the eyelets are seamless.

11. A device according to claim 6, wherein at least the center portion of at least one of the rods is semi-flexible.

12. A device according to claim 11, wherein the rods have a non-machinable hardness.

13. A device according to claim 11, wherein the rods have a hardness of at least Rockwell "C" 45.

14. A device according to claim 11, wherein the rods are of such hardness that the rods cannot be cut by hand tools.

* * * * *